US007198264B2

(12) United States Patent
Kashiba et al.

(10) Patent No.: US 7,198,264 B2
(45) Date of Patent: Apr. 3, 2007

(54) SHEET SUPPLYING DEVICE

(75) Inventors: Masayuki Kashiba, Shiga (JP); Yoshiyuki Horii, Kyoto (JP); Nobuyuki Kojima, Shiga (JP)

(73) Assignee: Horizon International Inc., Shiga (JP)

( * ) Notice: Subject to any disclaimer, the term of this patent is extended or adjusted under 35 U.S.C. 154(b) by 37 days.

(21) Appl. No.: 10/977,760

(22) Filed: Oct. 29, 2004

(65) Prior Publication Data

US 2005/0093223 A1 May 5, 2005

(30) Foreign Application Priority Data

Oct. 30, 2003 (JP) ..... 2003-369790

(51) Int. Cl.
*B65H 5/12* (2006.01)

(52) U.S. Cl. ..... 271/11; 271/94; 271/98; 271/10.02; 271/104

(58) Field of Classification Search ..... 271/11, 271/12, 94, 98, 10.02, 104, 105
See application file for complete search history.

(56) References Cited

U.S. PATENT DOCUMENTS 1,861,605 A * 6/1932 Maass ..... 271/104
3,100,110 A * 8/1963 Winkler et al. ..... 271/104
3,403,903 A * 10/1968 Caril ..... 271/20
4,345,752 A * 8/1982 Nakamura et al. ..... 271/12
4,541,624 A * 9/1985 Sasage et al. ..... 271/12

(Continued)

FOREIGN PATENT DOCUMENTS

JP 5-186074 7/1993

(Continued)

*Primary Examiner*—Patrick Mackey
*Assistant Examiner*—Jeremy Severson
(74) *Attorney, Agent, or Firm*—Hodgson Russ LLP

(57) ABSTRACT

In a sheet supplying device for feeding a sheet from a sheet stack configured by stacking plural sets of sheets collated by page order, each of which corresponds to one volume, for each set of sheets, in a state where the sheets are superimposed on one another so as to be sequentially offset from one another in a fore-to-aft direction, the sheet supplying device comprises: first transport means 2 for sucking a sheet in an uppermost position of a sheet stack P placed on a sheet table 1 so as to move the sheet rearward; second transport means 3 for sucking the sheet moved rearward by the first transport means 2 so as to transport the sheet forward; and a control unit 9 controlling suction operations of the first and second transport means 2, 3. The control unit 9 (i) allows the first transport means 2 to start the suction operation, and allows the first transport means 2 to suck the sheet in the uppermost position so as to move the sheet rearward, (ii) when it is determined on the basis of a detection signal from a sensor 4 that the sheet has reached a detection position of the sensor 4, allows the first transport means 2 to stop the suction operation and, also, the second transport means 3 to start the suction operation, allows the second transport means 3 to suck the sheet so as to transport the sheet forward, and allows the second transport means 3 to stop the suction operation, and (iii) repeats the operations (i) and (ii) for the subsequent sheets of the sheet stack P, until the sheets in a set of sheets, which corresponds to one volume, arm all transported.

8 Claims, 5 Drawing Sheets

U.S. PATENT DOCUMENTS 4,610,444 A * 9/1986 Lang et al. ..... 271/12
4,648,587 A * 3/1987 Hiromori et al. ..... 271/12
4,739,982 A * 4/1988 Hain ..... 271/94
4,768,769 A * 9/1988 Roller ..... 271/11
4,824,308 A * 4/1989 Carboniero et al. ..... 414/797
4,950,128 A * 8/1990 Sala ..... 414/796.9
5,071,110 A * 12/1991 Arnone et al. ..... 271/104
5,090,676 A * 2/1992 Matsuno et al. ..... 271/12
5,096,179 A * 3/1992 Schmitt ..... 271/9.03
5,234,207 A * 8/1993 Lindstrom et al. ..... 271/11
5,391,051 A * 2/1995 Sabatier et al. ..... 414/797.2
5,431,384 A * 7/1995 Obermiller et al. ..... 271/11
5,542,816 A * 8/1996 Wallin ..... 414/798.9
5,553,841 A * 9/1996 Greive ..... 271/104
5,803,447 A * 9/1998 Singer et al. ..... 271/11
5,836,582 A * 11/1998 Ogawa et al. ..... 271/12
5,884,907 A * 3/1999 Ohkoda ..... 271/90
5,893,554 A * 4/1999 Okahashi et al. ..... 271/98
6,010,125 A * 1/2000 Nakajima ..... 271/11
6,082,728 A * 7/2000 Ubayashi ..... 271/108
6,135,437 A * 10/2000 Maass et al. ..... 271/5
6,155,555 A * 12/2000 Maass ..... 271/98
6,176,481 B1 * 1/2001 Ohkoda ..... 271/9.05
6,402,134 B1 * 6/2002 Gauger et al. ..... 271/12
6,481,705 B1 * 11/2002 Okada ..... 271/4.03
6,485,010 B1 * 11/2002 Lamothe ..... 270/52.09
6,488,277 B2 * 12/2002 Herrmann ..... 271/22
6,543,759 B2 * 4/2003 Yamaguchi et al. ..... 271/98
6,669,187 B1 * 12/2003 Clark ..... 271/98
6,688,594 B2 * 2/2004 Dunninger et al. ..... 271/275
6,773,006 B2 * 8/2004 Andreyka et al. ..... 271/96
2004/0056410 A1 * 3/2004 Skadow et al. ..... 271/10.01
2005/0040584 A1 * 2/2005 Isemura ..... 271/97
2005/0189696 A1 * 9/2005 Hansch ..... 271/11
2006/0071394 A1 * 4/2006 Auf Der Maur ..... 271/10.01

FOREIGN PATENT DOCUMENTS

JP 11-79440 3/1999
JP 11-321153 11/1999
JP 2000-109227 4/2000

* cited by examiner

SHEET SUPPLYING DEVICE

TECHNICAL FIELD

The present invention relates to a sheet supplying device for feeding a sheet from a sheet stack configured by stacking plural sets of sheets collated by page order, each of which corresponds to one volume, for each set of sheets, in a state where the sheets are superimposed on one another so as to be sequentially offset from one another in a fore-to-aft direction.

BACKGROUND ART

JP1999-321153A describes a conventional sheet supplying device of this kind. The conventional sheet supplying device constitutes a part of a sheet accumulating apparatus shown in FIG. 5. Referring to FIG. 5, the sheet accumulating apparatus comprises a sheet feed section A, an inverting transport section B, a transport section C and an accumulation section D. Placed on the sheet feed section A is a sheet stack configured by stacking plural sets of sheets collated by page order, each of which corresponds to one volume. Then, sheets are sequentially fed for each set of sheets from the sheet feed section A in a state where the sheets are superimposed on one another so as to be sequentially offset from one another in a fore-to-aft direction. After that, the sheets are vertically inverted by the inverting transport section B, and are transported to the accumulation section D through the transport section C. In the accumulation section D, the received sheets are collated and accumulated as a set of sheets, which corresponds to one volume, and then, are supplied to a bookbinding machine (not shown).

A sheet supplying device is arranged in the sheet feed section A. The sheet supplying device comprises a vertically movable sheet table 30 on which a stack of sheets P is placed, a sheet feeding belt mechanism 31 which transmits the sheets P to the inverting transport section B, and a reverse belt mechanism 32 which is placed in parallel with the sheet feeding belt mechanism 31.

The sheet feeding belt mechanism 31 includes a drive motor 31*a*, a drive pulley 31*b* coupled to a drive shaft of the drive motor 31*a*, a pair of auxiliary rollers 31*c*, 31*d*, and an endless belt 31*e* extending among the drive pulley 31*b* and the pair of auxiliary rollers 31*c*, 31*d*. When the drive motor 31*a* is operated, the endless belt 31*e* are rotated and driven in a counterclockwise direction, so that the sheets P are transported one by one in a transport direction.

The reverse belt mechanism 32 includes a drive motor 32*a*, a drive pulley 32*b* coupled to a drive shaft of the drive motor 32*a*, a pair of auxiliary rollers 32*c*, 32*d*, and an endless belt 32*e* extending among the drive pulley 32*b* and the pair of auxiliary rollers 32*c*, 32*d*. When the drive motor 32*a* is operated, the endless belt 32*e* is rotated and driven in a clockwise direction.

In this case, during the sheet feeding operation, the sheet table 30 gradually moves upward, and a top surface of the sheet P in the uppermost position of the sheet stack is always in contact with the endless belt 31*e* of the sheet feeding belt mechanism 31 and the endless belt 32*e* of the reverse belt mechanism 32.

A sensor 33 for detecting a sheet is arranged in the rear of the sheet table 30. The sensor 33 includes a light emitting element 33*a* and a light receiving element 33*b*. Also arranged in the rear of the sheet table 30 is a duct 34 which jets air for separating sheets of the upper layer of the sheet stack one by one.

Thus, the sheet P in the uppermost position of the sheet stack placed on the sheet table 30 and separated therefrom by the air is moved rearward by the reverse belt mechanism 32. Then, when the sheet P in the uppermost position is moved to a detection position of the sensor 33, the reverse belt mechanism stops and, also, the sheet feeding belt mechanism 31 starts to operate on the basis of a sheet detection signal from the sensor 33. With the above operations, the sheet P in the uppermost position is transported forward to the inverting transport section B.

By repeating the above operations, a set of sheets, which corresponds to one volume, is fed in a state where the sheets are superimposed on one another so as to be sequentially offset from one another in a fore-to-aft direction.

In addition, when the sensor has detected double transportation of sheets, the sheet supplying device is stopped and the transportation error is modified. In addition, measurement of the number of sheets to be fed is used for determination on whether a set of sheets, which corresponds to one volume, has been fed.

An inverting transport device is arranged in the inverting transport section B. The inverting transport device includes a rotary drum 35 of a large diameter, a drive roller 35*c* and driven rollers 35*a*, 35*b* which are arranged so as to surround half of the circumference of the rotary drum 35, and an endless belt 35*d* which extends among these rollers 35*a* to 35*c* and a part of which is brought into contact with a periphery of the rotary drum 35 by pressure. Then, an aggregation of sheets fed from the sheet feed section A by the sheet feeding belt mechanism 31 is transported between the rotary drum 35 and the endless belt 35*d* from downside of the periphery of the rotary drum 35, during which the sheets are inverted vertically. Then, the sheets are transmitted to the transport section C from an upper position of the periphery of the rotary drum 35.

The transport section C includes a drive roller 37 arranged just before the accumulation section D and an endless belt 36 extending between the roller 37 and the rotary drum 35. In addition, a pair of auxiliary rollers 39 are brought into contact with the lower orbit of the endless belt 36. The endless belt 36 performs circumferential motion between the drive roller 37 and the rotary drum 35 at the same speed as peripheral velocity of the rotary drum 35. Pressing rollers 37*a*, 37*b*, 37*c* are arranged so as to be spaced from one another on the upper part of the endless belt 36. Thus, an aggregation of sheets vertically inverted, which corresponds to one volume, is transported by the transport section C.

When the aggregation of sheets is transferred from the transport section C to the accumulation section D, the aggregation of sheets is stacked in the accumulation section D, sequentially from a bottom sheet constituting the aggregation, with the edges of the sheets jogged as the end of the sheet abuts a jog plate 38. The sets of sheets accumulated in the accumulation section D are fed to the bookbinding machine.

Such a conventional sheet supplying device has an advantage that as a set of sheets, which corresponds to one volume, is transported In a state where the sheets are superimposed on one another so as to be sequentially offset from one another in a fore-to-aft direction, the sheet accumulating speed is fast even when the transport speed is rather slow, and that a trouble is less likely to occur in the process of sheet transportation or accumulation. However) as the response speed of the sheet feeding belt mechanism and the reverse belt mechanism is slow when their actuation/stop is switched, it is difficult to determine timing of switching operations of the sheet feeding belt mechanism and reverse belt mechanism. In addition, since the sheets are transported by circumferential motion of the belt, there has been a problem that a slip of a sheet impedes reliable transport of the sheet, so that the feeder is prone to a feed error.

SUMMARY OF THE INVENTION

It is therefore an object of the present invention to provide a sheet supplying device capable of performing a sheet feeding operation more reliably at higher speed.

According to the present invention, the above object is achieved by providing a sheet supplying device for feeding a sheet from a sheet stack configured by stacking plural sets of sheets collated by page order, each of which corresponds to one volume, for each set of sheets, in a state where the sheets are superimposed on one another so as to be sequentially offset from one another in a fore-to-aft direction, the sheet supplying device comprising: a frame; a sheet table arranged in the frame for vertical movement, the sheet stack being placed on said sheet table; a front vertical plate attached to the frame and arranged in proximity to the front of the sheet table with the sheet stack placed thereon; a sensor attached to the frame in the rear of the sheet table for detection of a sheet; first transport means attached to the frame above a rear end of the sheet table for sucking a rear end of a sheet in an uppermost position of the sheet stack placed on the sheet table so as to move the sheet to a detection position of the sensor toward the rear of the sheet table; second transport means arranged adjacent to the front of the transport means above the sheet table and attached to the frame for sucking the sheet in the uppermost position moved to the detection position of the sensor by the first transport means so as to transport the sheet forward beyond the front vertical plate; and control means controlling suction operations of the first and second transport means, wherein the control means (i) allows the first transport means to start the suction operation, and allows the first transport means to suck the sheet in the uppermost position of the sheet stack and to move the sheet to the detection position of the sensor, (ii) when it is determined on the basis of a detection signal from the sensor that the sheet in the uppermost position has reached the detection position of the sensor, allows the first transport means to stop the suction operation and, also, the second transport means to start the suction operation, allows the second transport means to suck the sheet in the uppermost position and to transport the sheet beyond the front vertical plate, and allows the second transport to stop the suction operation after completion of the transportation, and (iii) repeats the operations (i) and (ii) for the subsequent sheets of the sheet stack, until the sheets in a set of sheets, which corresponds to one volume, are all transported.

According to a preferred embodiment of the present invention, each of the first and second transport means includes: a suction roller rotatably supported on the frame above the sheet table and having plural suction holes on a periphery extending horizontally across the sheet table; a drive belt rotating the suction roller for guiding a sheet sucked up by the suction roller in a tangent direction of the suction roller, a drive pulley arranged for rotating the drive belt; a motor attached to the frame so as to rotate the drive pulley; a common vacuum pump, an intake pipe connecting the suction roller with the vacuum pump; and a solenoid valve arranged in the middle of the intake pipe, and wherein the suction roller of the first transport means is always rotated in a direction for transporting a sheet toward the rear of the sheet table by the related motor while the suction roller of the second transport means is always rotated in a direction for transporting a sheet toward the front of the sheet table by the related motor, and the control means controls the suction operations of the first and second transport means by switching opening/closing of the respective solenoid valves of the first and second transport means.

According to another preferred embodiment of the present invention, each of the first and second transport means includes: a drive roller rotatably supported on the frame above the sheet table and extending horizontally across the sheet table; at least one idle roller rotatably supported on the frame in a position spaced from the drive roller above the sheet table and extending horizontally across the sheet table; a motor attached to the frame so as to rotate the drive roller; a transport belt extending between the drive roller and the idle roller so as to perform circumferential motion, the transport belt having a number of suction holes on its transport surface and having a lower orbit extending at least in a sheet transport direction and opposed to a top surface of the sheet stack; an intake duct arranged in proximity to the above of the lower orbit of the transport belt and supported on the frame, the intake duct having an intake aperture opened downward; a common vacuum pump; an intake pipe connecting the intake duct with the vacuum pump; and a solenoid valve arranged in the middle of the intake pipe, and wherein the transport belt of the first transport means is always rotated in a direction for transporting a sheet toward the rear of the sheet table by the related motor while the transport belt of the second transport means is always rotated in a direction for transporting a sheet toward the front of the sheet table by the related motor, and the control means controls the suction operations of the first and second transport means by switching opening/closing of the respective solenoid valves of the first and second transport means.

According to still another preferred embodiment of the present invention, the sheet supplying device further comprises: a sheet press claw attached to a top end of the front vertical plate for vertical movement in such a manner that the sheet press claw always comes into contact with the front end of the top surface of the sheet stack placed on the sheet table by its own weight, wherein when the first transport means transports a sheet to the detection position of the sensor, the sheet escapes from the sheet press claw and, then, is transported forward beyond the sheet press claw by the second transport means.

According to yet another preferred embodiment of the present invention, a first page identification mark and a last page identification mark are assigned to rear end margins of a sheet corresponding to a first page and a sheet corresponding to a last page, respectively, for each set of sheets, which corresponds to one volume, and when the first transport means moves a sheet to the detection position of the sensor, the sensor or second sensors detect(s) the first page identification mark and the last page identification mark, and the control means controls a suction operation for each sheet feeding cycle of a set of sheets, which corresponds to one volume, on the basis of a first page detection signal and a last page detection signal from the sensor or the second sensors.

According to yet another preferred embodiment of the present invention, when it is determined on the basis of the detection signal from the sensor that double transportation of sheets occurs in the first transport means, the control means allows the fist and second transport means to stop the respective suction operations.

DETAILED DESCRIPTION OF THE PREFERRED EMBODIMENTS

Figure 1:
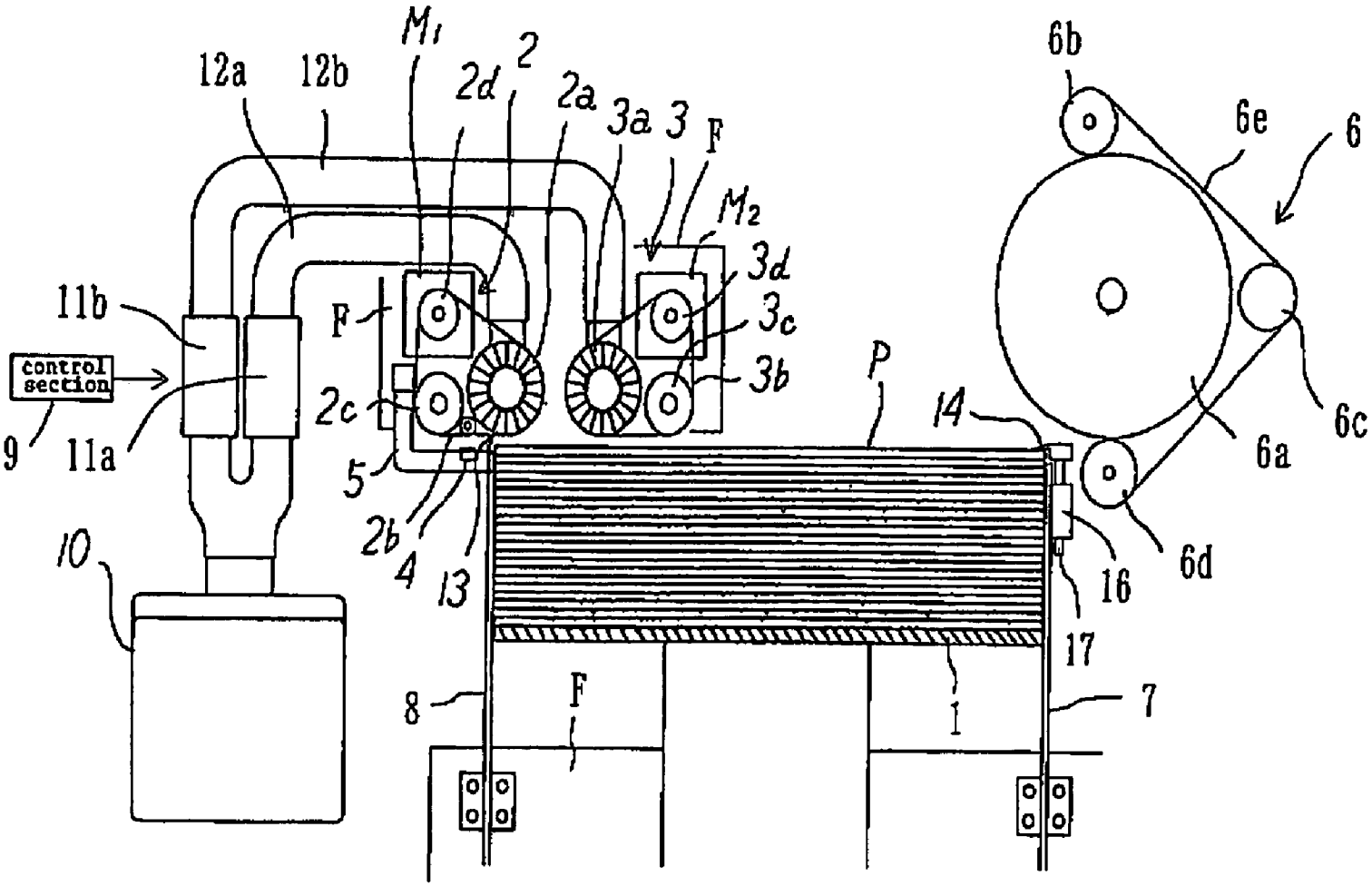
FIG. 1 is a side view schematically illustrating a configuration of a sheet supplying device according to one embodiment of the present invention.
Figure 2:
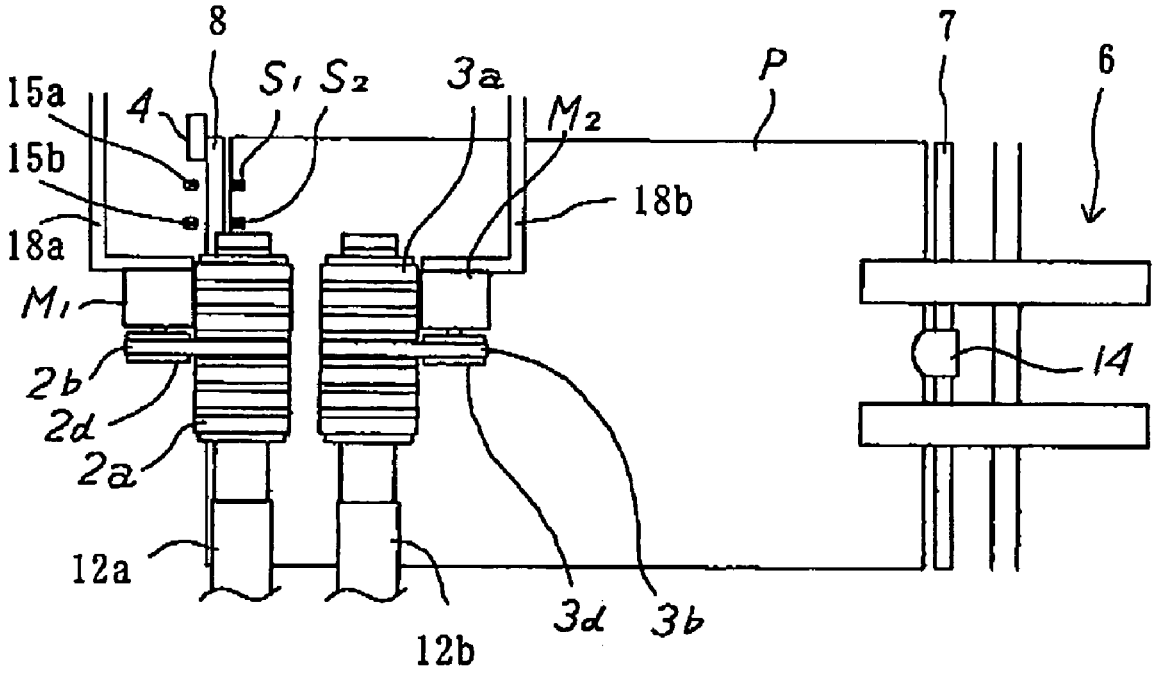
FIG. 2 is a plan view of the sheet supplying device shown in FIG. 1.

Hereinafter, description will be given of preferred embodiments of the present invention with reference to the accompanying drawings. FIG. 1 is a side view schematically illustrating a configuration of a sheet supplying device according to one embodiment of the present invention. FIG. 2 is a plan view of the sheet supplying device shown in FIG. 1. The sheet supplying device according to the present invention is adapted to feed a sheet from a sheet stack configured by stacking plural sets of sheets collated by page order, each of which corresponds to one volume, for each set of sheets, in a state where the sheets ate superimposed on one another so as to be sequentially offset from one another in a fore-to-aft direction.

Referring to FIGS. 1 and 2, the sheet supplying device according to the present invention comprises a frame F, a sheet table 1 which is arranged in the frame F for vertical movement and on which a sheet stack P is placed, and a front vertical plate 7 attached to the frame F and arranged in proximity to the front of the sheet table 1 with the sheet stack P placed thereon.

The sheet supplying device also comprises a sensor 4 attached to the frame F in the rear of the sheet table 1 for detecting a sheet, first transport means 2 attached to the frame F above a rear end of the sheet table 1 for sucking a rear end of a sheet in an uppermost position of the sheet stack P placed on the sheet table 1 so as to move the sheet to a detection position of the sensor 4 toward the rear of the sheet table 1, second transport means 3 arranged adjacent to the front of the first transport means 2 above the sheet table 1 and attached to the frame F for sucking the sheet in the uppermost position moved to the detection position of the sensor 4 by the first transport means 2 so as to transport the sheet forward beyond the front vertical plate 7, and a control unit 9 controlling the suction operations of the first and second transport means 2, 3.

The first transport means 2 includes a suction roller 2*a* which is rotatably supported on the frame F above the sheet table 1 and has plural suction holes on a periphery extending horizontally across the sheet table 1, a drive belt 2*b* which rotates the suction roller 2*a* and guides a sheet sucked up by the suction roller 2*a* in a tangent direction of the suction roller 2*a*, and a drive pulley 2*d* and a driven pulley 2*c* which rotate the drive belt 2*b*. The drive pulley 2*d* is attached to a drive shaft of a motor M1 attached to the frame F by way of a support member 18*a*, while the driven pulley 2*c* is attached to the frame F. Thus, the motor M1 rotates the drive pulley 2*d*, thereby allowing the drive belt 2*d* to perform circumferential motion, so that the suction roller 2*a* is always rotated in a direction for transporting a sheet toward the rear of the sheet table 1.

The second transport means 3 includes a suction roller 3*a* which is rotatably supported on the frame F above the sheet table 1 and has plural suction holes on a periphery extending horizontally across the sheet table 1, a drive belt 3*b* which rotates the suction roller 3*a* and guides a sheet sucked up by the suction roller 3*a* in a tangent direction of the suction roller 3*a*, and a drive pulley 3*d* and a driven pulley 3*c* which rotate the drive belt 3*b*. The drive pulley 3*d* is attached to a drive shaft of a motor M2 attached to the frame F by way of a support member 18*b*, while the driven pulley 3*d* is attached to the frame F. Thus, the motor M2 rotates the drive pulley 3*d*, thereby allowing the drive belt 3*b* to perform circumferential motion, so that the suction roller 3*a* is always rotated in a direction for transporting a sheet toward the front of the sheet table 1.

In addition, the first and second transport means 2, 3 are provided with a common vacuum pump 10 to which the suction roller 2*a* of the first transport means 2 and the suction roller 3*a* of the second transport means 3 are connected by way of intake pipes 12*a*, 12*b*, respectively. In this embodiment, each of the intake pipes 12*a*, 12*b* is made of a metal pipe having rigidity and, as can be seen from FIG. 2, is arranged with ends thereof protruding horizontally above the sheet table 1 in the direction traversing the sheet table 1. Then, the suction rollers 2*a*, 2*b* are attached rotatably around their axes, to the ends of the intake pipes 12*a*, 12*b*.

Thus, suction operations of the first and second transport means 2, 3 are controlled by opening/closing of solenoid valves 11*a*, 11*b*.

A sheet press claw 14 is attached to the top end of the front vertical plate 7 for a vertical movement. The sheet press claw 14 includes a vertical support rod 17 extending downward. The sheet press claw 14 is slidably inserted into a cylindrical bearing 16 having the support rod 17 attached to the front vertical plate 7. The sheet press claw 14 always comes into contact with a front end of a top face of the sheet stack P placed on the sheet table 1, by its own weight. When the first transport means 2 transports a sheet to a detection position of the sensor 4, the sheet escapes from the sheet press claw 14 and, then, is transported forward beyond the sheet press claw 14 by the second transport means 3. The sheet press claw 14 makes it possible to prevent two sheets from being pulled out together by the first transport means 2 (suction roller 2*a*), thereby providing more reliable sheet feeding operation.

In addition, a rear vertical plate 8 is arranged in proximity to the rear of the sheet table 1 with the sheet stack P placed thereon, and is attached to the frame F. A gate plate 13 is attached to the top end of the rear vertical plate 8. The gate plate 13 functions to prevent movement of a lower sheet when the first transport means 2 (suction roller 2*a*) sucks two sheets together.

Furthermore, an air jet pipe 5 is arranged adjacent to the gate plate 13. An air jet port of the air jet pipe 5 is oriented to the upper layer of the sheet stack P, so that sheets of the upper layer of the sheet stack P can be separated one by one by air blown off from the air jet port and the first transport means 2 can reliably suck the sheets one by one.

In FIG. 1, reference numeral 6 denotes an inverting transport device which receives sheets fed from the sheet supplying device of the present invention. The inverting transport device 6 includes a rotary drum 6*a*, a drive roller 6*b* and driven rollers 6*c*, 6*d* arranged so as to surround half of periphery of the rotary drum 6*a*, and an endless belt 6*e* which extends among these rollers 6*a* to 6*d* and a part of which is brought into contact with a periphery of the rotary drum 6*a* by pressure. In addition, a device that receives the sheets fed from the sheet supplying device of the present invention is not limited to the inverting transport device, and any device can be employed as long as it can receive sheets in a state where the sheets are superimposed on one another so as to be sequentially offset from one another in a fore-to-aft direction.

Figure 3:
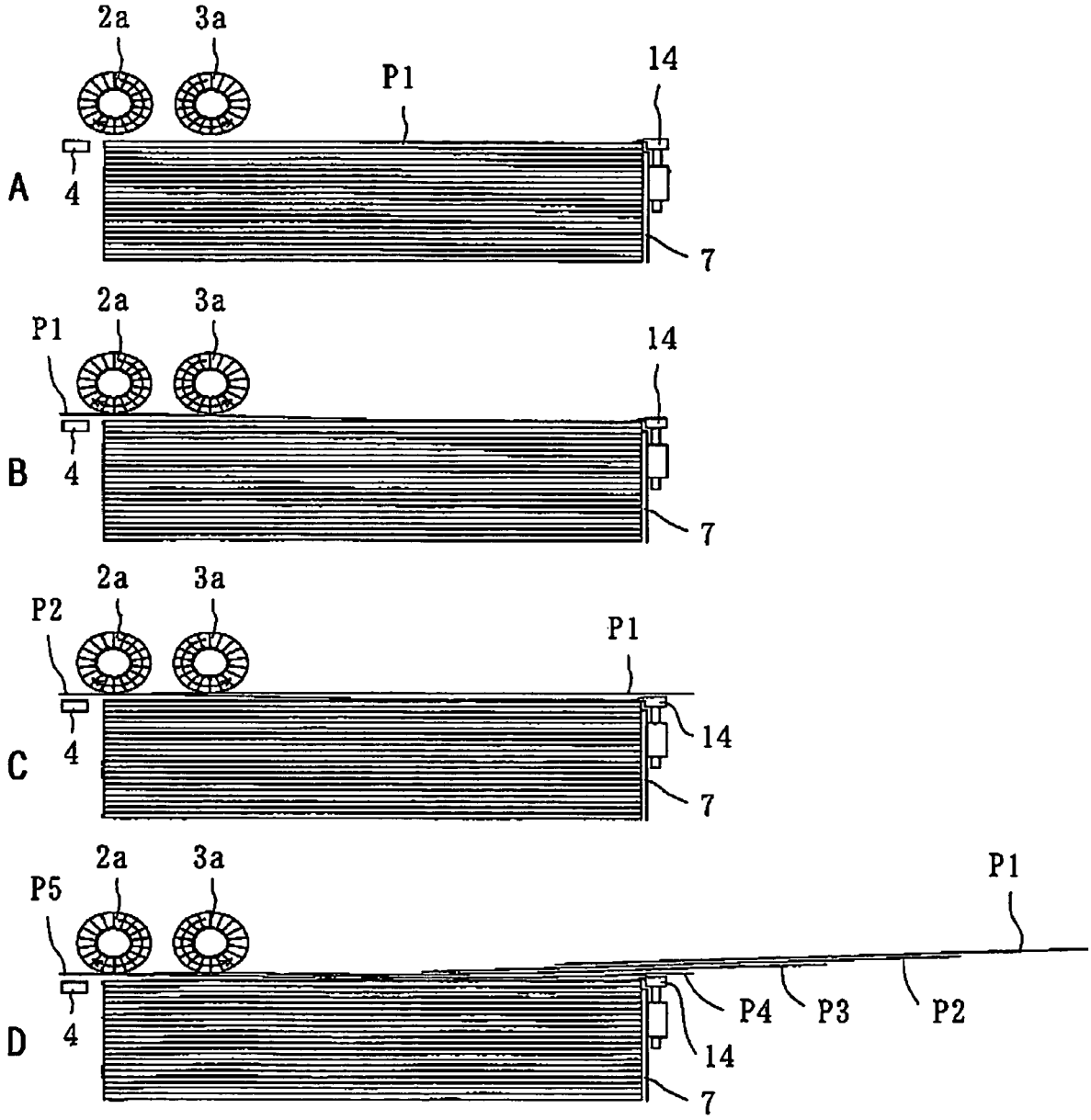
FIGS. 3A to 3D are side views each of which describes switching of suction operations of first and second transport means in the sheet supplying device shown in FIG. 1.

FIGS. 3A to 3D are side views each of which describes switching of the suction operations of the first and second transport means in the sheet supplying device shown in FIG. 1. Referring to FIGS. 3A to 3D, description will be given of the sheet feeding operation of the sheet supplying device according to the present invention. First, referring to FIGS. 3A and 3B, the control unit 9 opens the solenoid valve 11*a* and allows the first transport means 2 (suction roller 2*a*) to start the suction operation, and allows the first transport means 2 (suction roller 2*a*) to suck a sheet P1 in an uppermost position of the sheet stack P and to move the sheet P1 to a detection position of the sensor 4 (operation (i)). Next, referring to FIG. 3C, when it is determined on the basis of a detection signal from the sensor 4 that the sheet P1 in the uppermost position has reached the detection position of the sensor 4, the control unit 9 closes the solenoid valve 11*a*, thereby allowing the first transport means 2 (suction roller 2*a*) to stop the suction operation and, also, opens the solenoid valve 11*b*, thereby allowing the second transport means 3 (suction roller 3*a*) to start the suction operation, and allows the second transport means 3 (suction roller 3*a*) to suck the sheet P1 in the uppermost position and to transport the sheet P1 beyond the front vertical plate 7. Herein, the sheet P1 in the uppermost position is fed in between the rotary drum 6*a* and the belt 6*e* of the inverting transport device 6 beyond the sheet press claw 14. After completion of the transportation, the control unit 9 allows the second transport means 3 (suction roller 3*a*) to stop the suction operation (operation (ii)). Then, as shown in FIG. 3D, the control unit 9 repeats the operations (i) and (ii) for the subsequent sheets P2, P3, P4 . . . of the sheet stack P until the sheets in a set of sheets, which corresponds to one volume, are all transported (operation (iii)). With the above operations, a set of sheets, which corresponds to one volume, can be fed in a state where the sheets are superimposed on one another so as to be sequentially offset from one another in a fore-to-aft direction.

In this case, as shown in FIG. 2, a first page identification mark S1 and a last page identification mark S2 are assigned to rear end margins of a sheet corresponding to a first page and a sheet corresponding to a last page, respectively, for each set of sheets, which corresponds to one volume, and a pair of second sensors 15*a*, 15*b* for detecting the identification marks S1, S2 are arranged adjacent to the sensor 4. Then, when the first transport means 2 (suction roller 2*a*) moves a sheet to the detection position of the sensor, the second sensors 15*a*, 15*b* detect the first page identification mark S1 and the last page identification mark S2. With the above operations, the control unit 9 can control a suction operation for each sheet feeding cycle of a set of sheets, which correspond to one volume, on the basis of a first page detection signal and a last page detection signal from the second sensors 15*a*, 15*b*. Alternatively, the sensor 4 may detect these identification marks S1, S2 instead of the second sensors 15*a*, 15*b*.

In addition, the controller unit 9 is designed to stop the suction operations of the first and second transport means 2,3, when it is determined on the basis of the detection signal from the sensor 4 that double transportation of sheets occurs in the first transport means 2.

Figure 4:
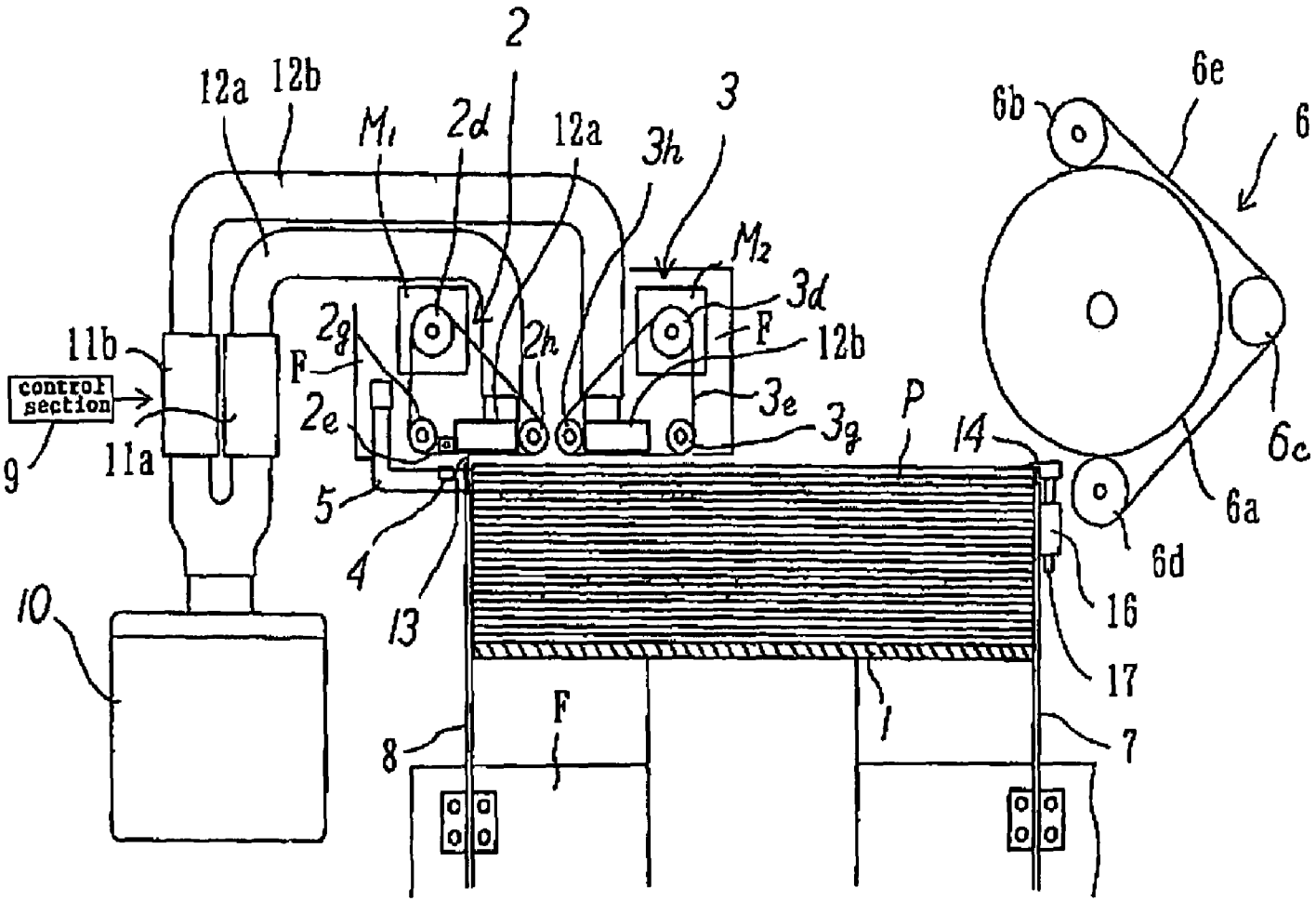
FIG. 4 is a side view schematically illustrating a configuration of a sheet supplying device according to another embodiment of the present invention.
Figure 5:
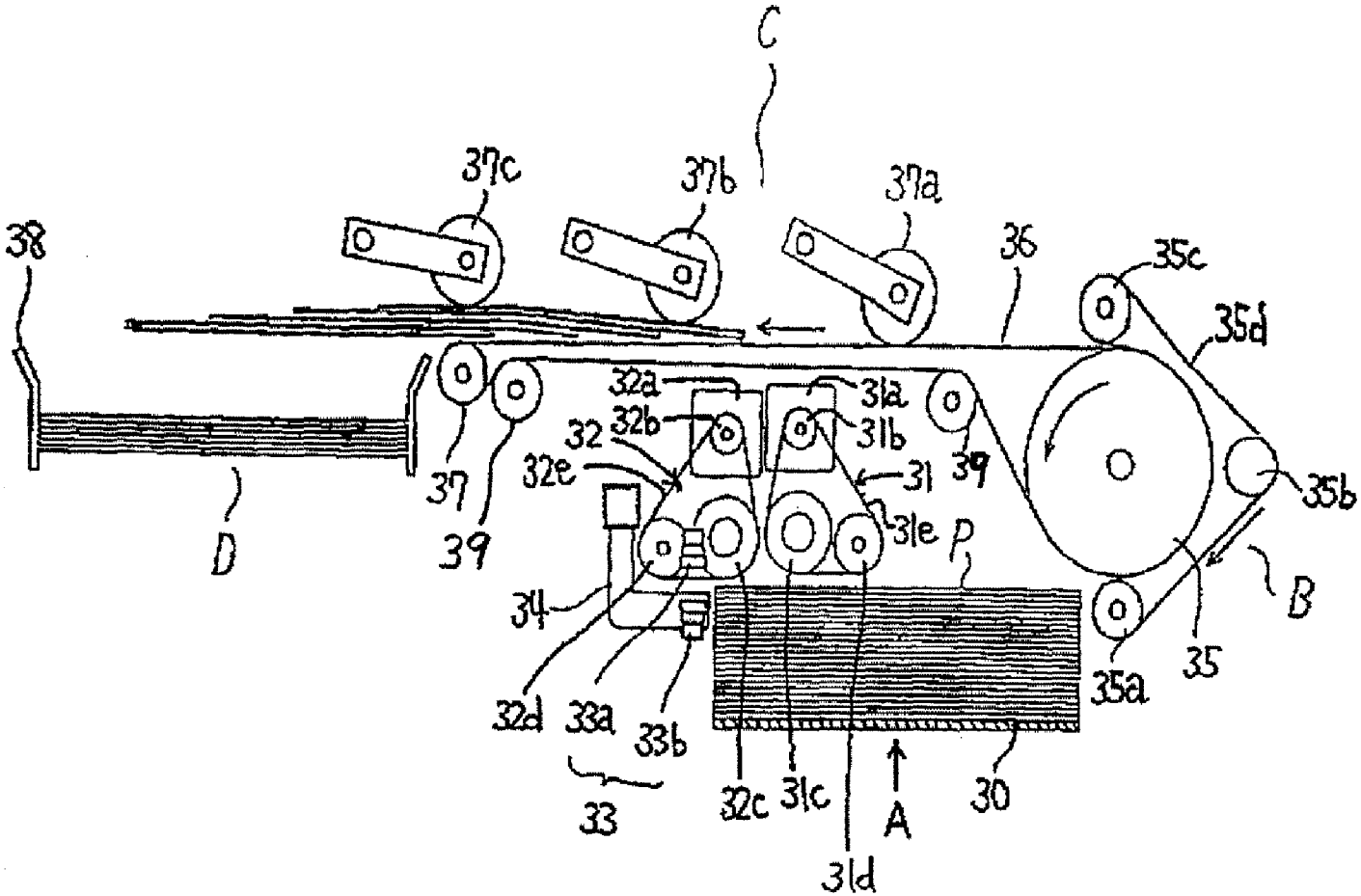
Fig. 5 (Prior Art)
FIG. 5 is a side view of a sheet accumulating apparatus comprising a conventional sheet supplying device.

FIG. 4 is a side view of a sheet supplying device according to another embodiment of the present invention. The, embodiment shown in FIG. 4 is different from that shown in FIG. 1 only in configurations of the first and second transport means. Thus, in FIG. 4, the same reference numerals are assigned to the same constituent components in the embodiment shown in FIG. 1; therefore, detailed description thereof will not be given here.

Referring to FIG. 4, in this embodiment, first transport means 2 includes a drive roller 2*d* rotatably supported on a frame F above a sheet table 1 and extending horizontally across the sheet table 1, two idle rollers 2*g*, 2*h* rotatably supported on the frame F in a position spaced from the drive roller 2*d* above the sheet table 1 and extending horizontally across the sheet table 1, and a motor M1 attached to the frame F so as to rotate the drive roller 2*d*.

Then, a transport belt 2*e* extends among the drive roller 2*d* and the idle rollers 2*g*, 2*h* to perform circumferential motion. The transport belt 2*e* has a number of intake apertures on its transport surface, extends at least in a direction for transporting a sheet, and has a lower orbit opposed to a top surface of a sheet stack P. The transport belt 2*e* is always rotated by the motor M1 in a direction for transporting a sheet to the rear of the sheet table 1.

In addition, an intake duct 12*a* having an intake aperture opened downward is arranged in proximity to the above of the lower orbit of the transfer belt 2*e*, and is supported on the frame F.

The second transport means 3 includes a drive roller 3*d* rotatably supported on the frame F above the sheet table 1 and extending horizontally across the sheet table 1, two idle rollers 3*g*, 3*h* rotatably supported on the frame F in a position spaced from the drive roller 3*d* above the sheet table 1 and extending horizontally across the sheet table 1, and a motor M2 attached to the frame F so as to rotate the drive roller 3*d*.

Then, a transfer belt 3*e* extends among the drive roller 3*d* and the idle rollers 3*g*, 3*h* to perform circumferential motion. The transfer belt 3*e* has a number of intake apertures on its transport surface, extends at least In a direction for transporting a sheet, and has a lower orbit opposed to a top surface of the sheet stack P. The transfer belt 3*e* is always rotated by the motor M2 in the direction for transporting a sheet to the front of the sheet table 1.

In addition, the first and second transport means 2, 3 has a common vacuum pump 10 to which an intake duct 12*a* of the first transport means 2 and an intake duct 12*b* of the second transport means 3 are connected.

In this embodiment, similar to that shown in FIG. 1, the control unit 9 switches the opening/closing of the solenoid valves 11*a*, 11*b*, thereby controlling the suction operations of the first and second transport means 2, 3, so that the sheet feeding operation can be performed.

As described above, according to the present invention, means for sucking a sheet by vacuum suction is provided on a pair of transport means for moving a sheet forward/rearward, the transport means themselves are continuously operated, and a suction operation of a sheet is stopped/started by opening/closing solenoid valve, so that a sheet feeding operation can be performed more reliably at higher speed.

What is claimed is:

1. A sheet supplying device for feeding a sheet from a sheet stack configured by stacking plural sets of sheets collated by page order, each of which corresponds to one volume, for each set of sheets, in a state where the sheets are superimposed on one another so as to be sequentially offset from one another in a fore-to-aft direction, the sheet supplying device comprising:

a frame;

a sheet table arranged in the frame for vertical movement, the sheet stack being placed on said sheet table;

a front vertical plate attached to the frame and arranged in proximity to the front of the sheet table with the sheet stack placed thereon;

a sensor attached to the frame in the rear of the sheet table for detection of a sheet;

first transport means attached to the frame above a rear end of the sheet table for sucking a rear end of a sheet in an uppermost position of the sheet stack placed on the sheet table so as to move the sheet to a detection position of the sensor toward the rear of the sheet table;

second transport means arranged adjacent to the front of the transport means above the sheet table and attached to the frame for sucking the sheet in the uppermost position moved to the detection position of the sensor by the first transport means so as to transport the sheet forward beyond the front vertical plate; and control means controlling suction operations of the first and second transport means, wherein each of the first and second transport means includes:

a suction roller rotatably supported on the frame above the sheet table and having plural suction holes on a periphery extending horizontally across the sheet table;

a drive belt rotating the suction roller for guiding a sheet sucked up by the suction roller in a tangent direction of the suction roller;

a drive pulley arranged for rotating the drive belt;

a motor attached to the frame so as to rotate the drive pulley;

a common vacuum pump;

an intake pipe connecting the suction roller with the vacuum pump; and a solenoid valve arranged in the middle of the intake pipe, and wherein the suction roller of the first transport means is always rotated in a direction for transporting a sheet toward the rear of the sheet table by the related motor while the suction roller of the second transport means is always rotated in a direction for transporting a sheet toward the front of the sheet table by the related motor, and wherein the control means (i) allows the first transport means to start the suction operation by opening the solenoid valve of the first transport means, and allows the first transport means to suck the sheet in the uppermost position of the sheet stack so as to move the sheet to the detection position of the sensor, (ii) when it is determined on the basis of a detection signal from the sensor that the sheet in the uppermost position has reached the detection position of the sensor, allows the first transport means to stop the suction operation by closing the solenoid valve of the first transport means and, also, the second transport means to start the suction operation by opening the solenoid valve of the second transport means, allows the second transport means to suck the sheet in the uppermost position so as to transport the sheet beyond the front vertical plate, and allows the second transport means to stop the suction operation by closing the solenoid valve of the second transport means after completion of the transportation, and (iii) repeats the operations (i) and (ii) for the subsequent sheets of the sheet stack, until the sheets in a set of sheets, which corresponds to one volume, are all transported.

2. The sheet supplying device according to claim 1, further comprising:

a sheet press claw attached to a top end of the front vertical plate for vertical movement in such a manner that the sheet press claw always comes into contact with the front end of the top surface of the sheet stack placed on the sheet table by its own weight, wherein when the first transport means transports a sheet to the detection position of the sensor, the sheet escapes from the sheet press claw and, then, is transported forward beyond the sheet press claw by the second transport means.

3. The sheet supplying device according to claim 1, wherein a first page identification mark and a last page identification mark are assigned to rear end margins of a sheet corresponding to a first page and a sheet corresponding to a last page, respectively, for each set of sheets, which corresponds to one volume, and when the first transport means moves a sheet to the detection position of the sensor, the sensor or second sensors detect(s) the first page identification mark and the last page identification mark, and the control means controls a suction operation for each sheet feeding cycle of a set of sheets, which corresponds to one volume, on the basis of a first page detection signal and a last page detection signal from the sensor or the second sensors.

4. The sheet supplying device according to claim 1, wherein when it is determined on the basis of the detection signal from the sensor that double transportation of sheets occurs in the first transport means, the control means allows the first and second transport means to stop the respective suction operations.

5. A sheet supplying device for feeding a sheet from a sheet stack configured by stacking plural sets of sheets collated by page order, each of which corresponds to one volume, for each set of sheets, in a state where the sheets are superimposed on one another so as to be sequentially offset from one another in a fore-to-aft direction, the sheet supplying device comprising:

a frame;

a sheet table arranged in the frame for vertical movement, the sheet stack being placed on said sheet table;

a front vertical plate attached to the frame and arranged in proximity to the front of the sheet table with the sheet stack placed thereon;

a sensor attached to the frame in the rear of the sheet table for detection of a sheet;

first transport means attached to the frame above a rear end of the sheet table for sucking a rear end of a sheet in an uppermost position of the sheet stack placed on the sheet table so as to move the sheet to a detection position of the sensor toward the rear of the sheet table;

second transport means arranged adjacent to the front of the transport means above the sheet table and attached to the frame for sucking the sheet in the uppermost position moved to the detection position of the sensor by the first transport means so as to transport the sheet forward beyond the front vertical plate; and control means controlling suction operations of the first and second transport means, wherein each of the first and second transport means includes:

a drive roller rotatably supported on the frame above the sheet table and extending horizontally across the sheet table;

at least one idle roller rotatably supported on the frame in a position spaced from the drive roller above the sheet table and extending horizontally across the sheet table;

a motor attached to the frame so as to rotate the drive roller;

a transport belt extending between the drive roller and the idle roller so as to perform circumferential motion, the transport belt having a number of suction holes on its transport surface and having a lower orbit extending at least in a sheet transport direction and opposed to a top surface of the sheet stack;

an intake duct arranged in proximity to the above of the lower orbit of the transport belt and supported on the frame, the intake duct having an intake aperture opened downward;

a common vacuum pump;

an intake pipe connecting the intake duct with the vacuum pump; and a solenoid valve arranged in the middle of the intake pipe, and wherein the transport belt of the first transport means is always rotated in a direction for transporting a sheet toward the rear of the sheet table by the related motor while the transport belt of the second transport means is always rotated in a direction for transporting a sheet toward the front of the sheet table by the related motor, and wherein the control means (i) allows the first transport means to start the suction operation by opening the solenoid valve of the first transport means, and allows the first transport means to suck the sheet in the uppermost position of the sheet stack so as to move the sheet to the detection position of the sensor, (ii) when it is determined on the basis of a detection signal from the sensor that the sheet in the uppermost position has reached the detection position of the sensor, allows the first transport means to stop the suction operation by closing the solenoid valve of the first transport means and, also, the second transport means to start the suction operation by opening the solenoid valve of the second transport means, allows the second transport means to suck the sheet in the uppermost position so as to transport the sheet beyond the front vertical plate, and allows the second transport means to stop the suction operation by closing the solenoid valve of the second transport means after completion of the transportation, and (iii) repeats the operations (i) and (ii) for the subsequent sheets of the sheet stack, until the sheets in a set of sheets, which corresponds to one volume, are all transported.

6. The sheet supplying device according to claim 5, further comprising:

a sheet press claw attached to a top end of the front vertical plate for vertical movement in such a manner that the sheet press claw always comes into contact with the front end of the top surface of the sheet stack placed on the sheet table by its own weight, wherein when the first transport means transports a sheet to the detection position of the sensor, the sheet escapes from the sheet press claw and, then, is transported forward beyond the sheet press claw by the second transport means.

7. The sheet supplying device according to claim 5, wherein a first page identification mark and a last page identification mark are assigned to rear end margins of a sheet corresponding to a first page and a sheet corresponding to a last page, respectively, for each set of sheets, which corresponds to one volume, and when the first transport means moves a sheet to the detection position of the sensor, the sensor or second sensors detect(s) the first page identification mark and the last page identification mark, and the control means controls a suction operation for each sheet feeding cycle of a set of sheets, which corresponds to one volume, on the basis of a first page detection signal and a last page detection signal from the sensor or the second sensors.

8. The sheet supplying device according to claim 5, wherein when it is determined on the basis of the detection signal from the sensor that double transportation of sheets occurs in the first transport means, the control means allows the first and second transport means to stop the respective suction operations.

* * * * *